US011238774B2

(12) United States Patent
Zeng et al.

(10) Patent No.: US 11,238,774 B2
(45) Date of Patent: Feb. 1, 2022

(54) METHOD OF DISPLAYING IMAGE FOR ORGANIC LIGHT-EMITTING DIODE DISPLAY DEVICE COMPARING TOTAL CURRENT OF THE SUBPIXELS WITH A TOTAL CURRENT THRESHOLD

(71) Applicant: Shenzhen China Star Optoelectronics Semiconductor Display Technology Co., Ltd., Shenzhen (CN)

(72) Inventors: Yuchao Zeng, Shenzhen (CN); Zhenling Wang, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 139 days.

(21) Appl. No.: 16/624,361

(22) PCT Filed: Nov. 18, 2019

(86) PCT No.: PCT/CN2019/119058
§ 371 (c)(1),
(2) Date: Dec. 19, 2019

(87) PCT Pub. No.: WO2021/088116
PCT Pub. Date: May 14, 2021

(65) Prior Publication Data
US 2021/0280124 A1 Sep. 9, 2021

(30) Foreign Application Priority Data
Nov. 5, 2019 (CN) ..... 201911070028.1

(51) Int. Cl.
*G09G 3/20* (2006.01)

(52) U.S. Cl.
CPC ... *G09G 3/2074* (2013.01); *G09G 2320/0285* (2013.01); *G09G 2320/0626* (2013.01); *G09G 2330/021* (2013.01); *G09G 2360/16* (2013.01)

(58) Field of Classification Search
CPC ..... G09G 3/20; G09G 3/2007; G09G 3/2074; G09G 3/30; G09G 3/32; G09G 3/3208; G09G 3/3233; G09G 3/3241; G09G 3/3283; G09G 2320/0233; G09G 2320/0285; G09G 2320/0626; G09G 2330/021; G09G 2330/025; G09G 2360/16
See application file for complete search history.

(56) References Cited

U.S. PATENT DOCUMENTS

2004/0201582 A1* 10/2004 Mizukoshi ..... G09G 3/3291 345/211
2008/0180367 A1* 7/2008 Lee ..... G09G 3/3225 345/80

(Continued)

*Primary Examiner* — Keith L Crawley

(57) ABSTRACT

A method of displaying an image and an image display device are disclosed. The method is implemented by calculating a total current value of subpixels of an image to be displayed, and comparing the total current value of the subpixels with a total current threshold, thereby to output a gain factor for adjusting brightness of an image to be displayed, so that an original subpixel dataset can be adjusted according to the gain factor, enabling power consumption to be correspondingly limited at the time when an image is displayed to meet a high brightness requirement.

4 Claims, 4 Drawing Sheets

(56) References Cited

U.S. PATENT DOCUMENTS

| | | | | |
|---|---|---|---|---|
| 2008/0252628 | A1* | 10/2008 | Han | G09G 5/10 345/207 |
| 2012/0044270 | A1* | 2/2012 | Arkhipov | G09G 3/32 345/690 |
| 2014/0152704 | A1* | 6/2014 | Jeong | G09G 3/3233 345/690 |
| 2014/0160173 | A1* | 6/2014 | Lee | G09G 3/3225 345/690 |
| 2014/0176620 | A1* | 6/2014 | Yano | G09G 3/3208 345/690 |
| 2014/0354699 | A1* | 12/2014 | Shin | G09G 3/2022 345/690 |

* cited by examiner

METHOD OF DISPLAYING IMAGE FOR ORGANIC LIGHT-EMITTING DIODE DISPLAY DEVICE COMPARING TOTAL CURRENT OF THE SUBPIXELS WITH A TOTAL CURRENT THRESHOLD

RELATED APPLICATIONS

This application is a National Phase of PCT Patent Application No. PCT/CN2019/119058 having International filing date of Nov. 18, 2019, which claims the benefit of priority of Chinese Patent Application No. 201911070028.1 filed on Nov. 5, 2019. The contents of the above applications are all incorporated by reference as if fully set forth herein in their entirety.

FIELD AND BACKGROUND OF THE INVENTION

The present invention relates to a technical field of displays, and particularly to, a method of displaying an image and an image display device.

Active matrix organic light-emitting diodes (AMOLEDs) are pixel self-luminous displays. In order to meet requirements of display performance for users, AMOLEDs are generally required of hither brightness. However, images displayed by a large number of pixels having high brightness values takes more power consumption than images displayed by a small number of pixels having high brightness values, leading to a high power consumption when images displayed by a large number of pixels having high brightness values.

SUMMARY OF THE INVENTION

An object of the present invention is to provide a method of displaying an image and an image display device to ensure that power consumption can be limited at the time when the image display device displays an image of high brightness.

In order to achieve the above-mentioned object, the present application provides a method of displaying an image, the method comprising following steps: step a: calculating a total current value of subpixels of an image to be displayed according to original subpixel grayscale data and subpixel current lookup table data of the image to be displayed; step b: comparing the total current value of the subpixels with a total current threshold, and if the total current value of the subpixels is less than or equal to the total current threshold, a gain factor of a present stage is equal to a gain factor of a previous stage; and if the total current value of the subpixels is greater than the total current threshold, the gain factor is equal to the previous stage gain factor multiplied by a current gain factor; wherein the previous stage gain factor is a product of a brightness gain factor and a power consumption gain factor, the brightness gain factor is obtained according to original brightness data of the image to be displayed and a predetermined brightness value, the power consumption gain factor is obtained according to original power consumption data of the image to be displayed and a predetermined power consumption value, and the current gain factor is equal to a ratio of the total current threshold to the total current value of the subpixels; step c: calculating and outputting a target subpixel dataset according to the gain factor and an original subpixel dataset, wherein the original subpixel dataset is called from a frame buffer; and step d: displaying the image according to the target subpixel dataset.

In the method of displaying the image, step a comprises establishing a subpixel grayscale histogram according to the original subpixel grayscale data; and summing current of each of the subpixels according to the subpixel grayscale histogram and the subpixel current lookup table data to obtain the total current value of the subpixels of the image to be displayed.

In the method of displaying the image, step c comprises obtaining, by multiplying the gain factor by data in the original subpixel dataset, the target subpixel dataset.

In the method of displaying the image, the method further comprises following steps: step e: calculating and updating subpixel grayscale data according to the gain factor and the original subpixel grayscale data; wherein step a further comprises calculating and updating the total current value of the subpixels according to the updated subpixel grayscale data and the subpixel current lookup table data; wherein step b further comprises comparing the updated total current value of the subpixels with the total current threshold, and if the updated total current value of the subpixels is not equal to the total current threshold, update the gain factor; wherein the updated gain factor is equal to a ratio of the non-updated gain factor multiplied the total current threshold to the updated total current value of the subpixels, and the updated gain factor is used to be input to step e to replace the non-updated gain factor in step e; and if the updated total current value of the subpixels is equal to the total current threshold, output the gain factor to step c.

In the method of displaying the image, prior to step a, the method further comprises inputting the original subpixel dataset.

A method of displaying an image comprises following steps: step a: calculating a total current value of subpixels of an image to be displayed according to original subpixel grayscale data and subpixel current lookup table data of the image to be displayed; step b: comparing the total current value of the subpixels with a total current threshold, and if the total current value of the subpixels s less than or equal to the total current threshold, a gain factor of a present stage is equal to a gain factor of a previous stage; and if the total current value of the subpixels is greater than the total current threshold, the gain factor is equal to the previous stage gain factor multiplied by a current gain factor; wherein the previous stage gain factor is a product of a brightness gain factor and a power consumption gain factor, the brightness gain factor is obtained according to original brightness data of the image to be displayed and a predetermined brightness value, the power consumption gain factor is obtained according to original power consumption data of the image to be displayed and a predetermined power consumption value, and the current gain factor is equal to a ratio of the total current threshold to the total current value of the subpixels; step c: calculating and outputting a target subpixel dataset according to the gain factor and an original subpixel dataset; and step d: displaying the image according to the target subpixel dataset.

In the method of displaying the image, step a comprises establishing a subpixel grayscale histogram according to the original subpixel grayscale data; and summing current of each of the subpixels according to the subpixel grayscale histogram and the subpixel current lookup table data to obtain the total current value of the subpixels of the image to be displayed.

In the method of displaying the image, step c comprises obtaining, by multiplying the gain factor by data in the original subpixel dataset, the target subpixel dataset.

In the method of displaying the image, the method further comprises following steps: step e: calculating and updating subpixel grayscale data according to the gain factor and the original subpixel grayscale data; wherein step a further comprises: calculating and updating the total current value of the subpixels according to the updated subpixel grayscale data and the subpixel current lookup table data; wherein step b further comprises comparing the updated total current value of the subpixels with the total current threshold, and if the updated total current value of the subpixels is not equal to the total current threshold, update the gain factor; wherein the updated gain factor is equal to a ratio of the non-updated gain factor multiplied by the total current threshold to the updated total current value of the subpixels, and the updated gain factor is used to be input to step e to replace the non-updated gain factor in step e; and if the updated total current value of the subpixels is equal to the total current threshold, output the gain factor to step c.

In the method of displaying the image, prior to step a, the method further comprises inputting the original subpixel dataset.

An image display device comprises a subpixel total current value calculation module configured to calculate a total current value of pixels of an image to be displayed according to original subpixel grayscale data and subpixel current lookup table data of the image to be displayed; a gain factor calculation module configured to compare the total current value of the subpixels with a total current threshold, and if the total current value of the subpixels is less than or equal to the total current threshold, a gain factor of a present stage is equal to a gain factor of a previous stage; and if the total current value of the subpixels is greater than the total current threshold, the gain factor is equal to the previous stage gain factor multiplied by a current gain factor; wherein the previous stage gain factor is a product of a brightness gain factor and a power consumption gain factor, the brightness gain factor is obtained according to original brightness data of the image to be displayed and a predetermined brightness value, the power consumption gain factor is obtained according to original power consumption data of the image to be displayed and a predetermined power consumption value, and the current gain factor is equal to a ratio of the total current threshold to the total current value of the subpixels; a target subpixel dataset output module configured to calculate and output a target subpixel dataset according to the gain factor and an original subpixel dataset; and a displaying module configured to display the image according to the target subpixel dataset.

In the image display device, the subpixel total current value calculation module comprises a grayscale histogram establishing module configured to establish a subpixel grayscale histogram according to the original subpixel grayscale data; and a total current value calculation module configured to sum current of each of the subpixels according to the subpixel grayscale histogram and the subpixel current lookup table data to obtain the total current value of the subpixels of the image to be displayed.

In the image display device, the target subpixel dataset output module is configured to obtain the target subpixel dataset by multiplying the gain factor by data in the original subpixel dataset.

In the image display device, the image display device further comprises a subpixel grayscale data calculation module configured to calculate and update subpixel grayscale data according to the gain factor and the original subpixel grayscale data; wherein the subpixel total current value calculation module is further configured to calculate and update the total current value of the subpixels according to the updated subpixel grayscale data and the subpixel current lookup table data; the gain factor calculation module is further configured to compare the updated total current value of the subpixels with the total current threshold, and if the updated total current value of the subpixels is not equal to the total current threshold, update the gain factor; wherein the updated gain factor is equal to a ratio of the non-updated gain factor multiplied by the total current threshold to the updated total current value of the subpixels; and the updated gain factor is used to be input to the subpixel grayscale data calculation module to replace the non-updated gain factor, and if the updated total current value of the subpixels is equal to the total current threshold, the gain factor is output to the target subpixel dataset output module.

In the image display device, the image display device further comprises an input module configured to input the original subpixel dataset.

The present application provides a method of displaying an image and an image display device. The method is implemented by calculating a total current value of subpixels of an image to be displayed, and comparing the total current value of the subpixels with a total current threshold, thereby to output a gain factor for adjusting brightness of an image to be displayed, so that an original subpixel dataset can be adjusted according to the gain factor, thereby enabling power consumption to be correspondingly limited at the time when an image is displayed to meet a high brightness requirement.

DESCRIPTION OF SPECIFIC EMBODIMENTS OF THE INVENTION

The technical solutions in the embodiments of the present application will be clearly and completely described in the following with reference to the accompanying drawings in the embodiments. Apparently, the embodiments as described are only a part, but not all, of the embodiments of the present application. Based on the embodiments in the present application, all other embodiments obtained by those skilled in the art without creative efforts shall be within the scope of the present application.

Figure 1:
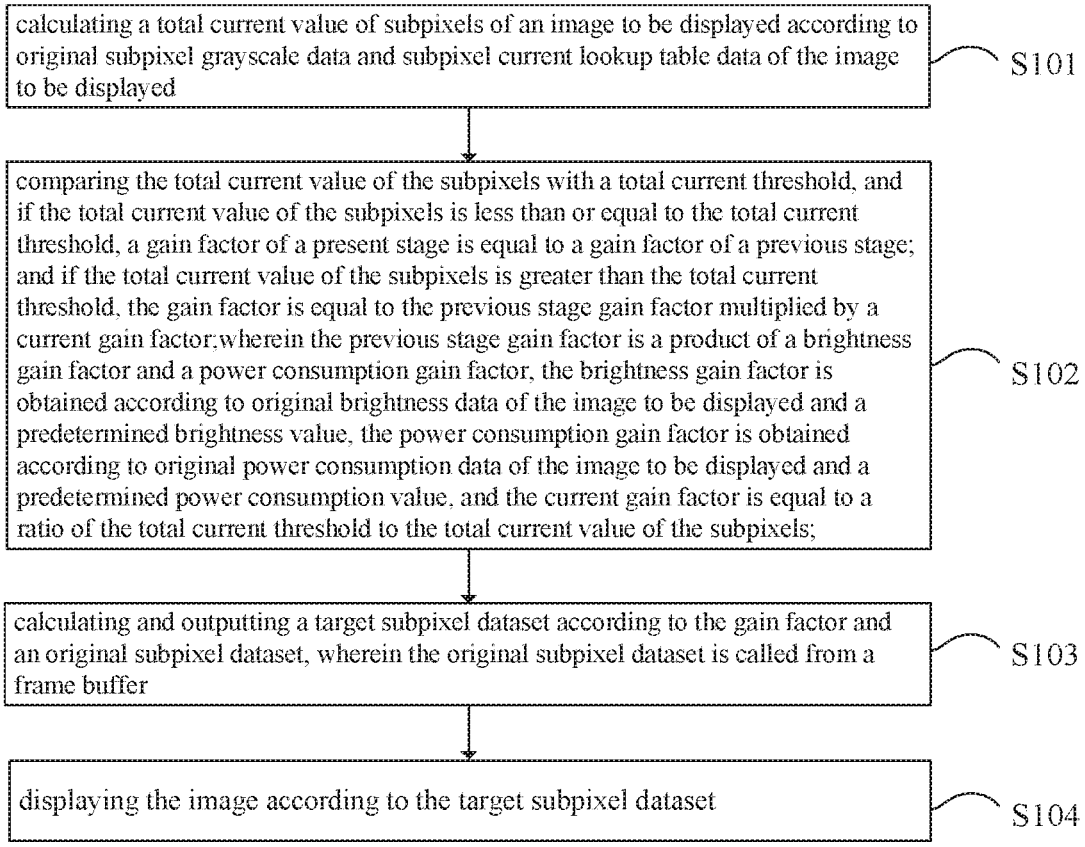
FIG. 1 is a flowchart showing a method of displaying an image of an embodiment of the present application.

Please refer to FIG. 1 showing a flowchart of a method of displaying an image of an embodiment of the present application. The method of displaying an image includes steps as follows:

S101: calculating a total current value of subpixels of an image to be displayed according to original subpixel grayscale data and subpixel current lookup table data of the image to be displayed.

Prior to implementing step S101, the method of displaying the image further includes inputting original subpixel dataset of the image to be displayed. The original subpixel data set includes the original subpixel grayscale data. Compared to the original subpixel dataset including original brightness data, the original subpixel grayscale data occupies less storage space. Subpixels include red subpixels, blue subpixels, and green subpixels. Generally, when each of the subpixels consists of 8 bits, a grayscale range of a red subpixel is 0-255, a grayscale range of a blue subpixel is 0-255, and a gray-scale range of a green subpixel is 0-255. The original subpixel grayscale data includes grayscale data of a plurality of subpixels in an image to be displayed. Data of a subpixel current lookup table is stored in a memory. The subpixel current lookup table includes current values of different color sub-pixels at different grayscales. For example, a current value of the red subpixel corresponding to a grayscale of 0 is $Ir_1$, and a current value corresponding to a gray level of 127 is $Ir_{127}$. A current value of the blue subpixel corresponding to a grayscale of 0 is $Ib_1$, and a current value corresponding to a grayscale of 127 is $Ib_{127}$. A current value of the green subpixel corresponding to a grayscale of 0 is $Ig_1$, and a current value corresponding to a grayscale of 127 is $Ig_{127}$.

In this embodiment, step S101 includes establishing a subpixel grayscale histogram according to the original subpixel grayscale data.

Specifically, create a two-dimensional subpixel grayscale histogram based on the original subpixel grayscale data. An abscissa of the grayscale histogram of the subpixels represents the grayscale of the subpixels of different colors, and an ordinate represents number. For example, a number of red subpixels with a grayscale of 0 is m, and a number of blue subpixels with a grayscale of 127 is n.

Sum current of each of the subpixels according to the subpixel grayscale histogram and the subpixel current lookup table data to obtain the total current value of the subpixels of the image to be displayed.

Specifically, according to the correspondence between grayscales of different color subpixels and current values in the subpixel current lookup table, multiply currents of subpixels having a same color and a same grayscale by a corresponding number, respectively, and add currents of different grayscales of the three color subpixels, thereby to calculate and obtain the total current value of the subpixels of the image to be displayed.

S102: comparing the total current value of the subpixels with a total current threshold, and if the total current value of the subpixels is less than or equal to the total current threshold, a gain factor of a present stage is equal to a gain factor of a previous stage; and if the total current value of the subpixels is greater than the total current threshold, the gain factor is equal to the previous stage gain factor multiplied by a current gain factor. The previous stage gain factor is a product of a brightness gain factor and a power consumption gain factor. The brightness gain factor is obtained according to original brightness data of the image to be displayed and a predetermined brightness value. The power consumption gain factor is obtained according to original power consumption data of the image to be displayed and a predetermined power consumption value, and the current gain factor is equal to a ratio of the total current threshold to the total current value of the subpixels.

If the total current value of the subpixels is less than or equal to the total current threshold, there is no need to reduce a scale of the image to be displayed. In other words, it only needs to adjust data in the original subpixel dataset according to a gain factor of a pervious stage for adjusting brightness of the image to be displayed and power consumption, so that the power consumption of displaying an image can be limited when the display image is in a high brightness condition. If the total current value of the subpixels is greater than the total current threshold, the display image needs to be scaled down. A current gain factor for scaling down is equal to a ratio of the total current threshold to the total current value of the subpixels. Furthermore, a gain factor is obtained by multiplying the current gain factor by the previous stage gain factor, thereby realizing that brightness of the image to be displayed is ensured at the time when the image to be displayed is scaled down, as well as reducing power consumption when displaying an image.

It should be noted that the brightness gain factor may be equal to the predetermined brightness value divided by a maximum brightness value of each of the subpixels of the image to be displayed. The predetermined brightness value is a brightness threshold of one subpixel as designed, and the power consumption gain factor is equal to the predetermined power consumption value divided by a maximum power consumption of each of the subpixels of the image to be displayed. The power consumption of each of the subpixels is equal to a product of a driving voltage multiplied bay current flowing through the subpixel.

S103: calculating and outputting a target subpixel dataset according to the gain factor and the original subpixel dataset.

Specifically, the original subpixel dataset being input is stored in a frame buffer, and is called from the frame buffer when needed. The target subpixel dataset is obtained by multiplying the gain factor by data in the original subpixel dataset. Data in the original subpixel dataset includes the original subpixel grayscale data. The gain factor multiplied by the grayscale data of each of the subpixels enables an adjustment of brightness and power consumption of the image to be displayed, and correspondingly limits current of the image to be displayed, thereby reducing power consumption when displaying an image.

S104: displaying the image according to the target subpixel dataset.

Specifically, a driving signal is output to pixels on a display panel according to data in the target subpixel dataset for image display. The driving signal includes a data signal.

A method of displaying an image of the embodiment of the present application is implemented by calculating a total current value of subpixels of an image to be displayed, and comparing the total current value of the subpixels with a total current threshold, thereby to output a gain factor for adjusting brightness of an image to be displayed, so that an original subpixel dataset can be adjusted according to the gain factor, thereby enabling power consumption to be correspondingly limited at the time when an image is displayed to meet a high brightness requirement.

Figure 2:
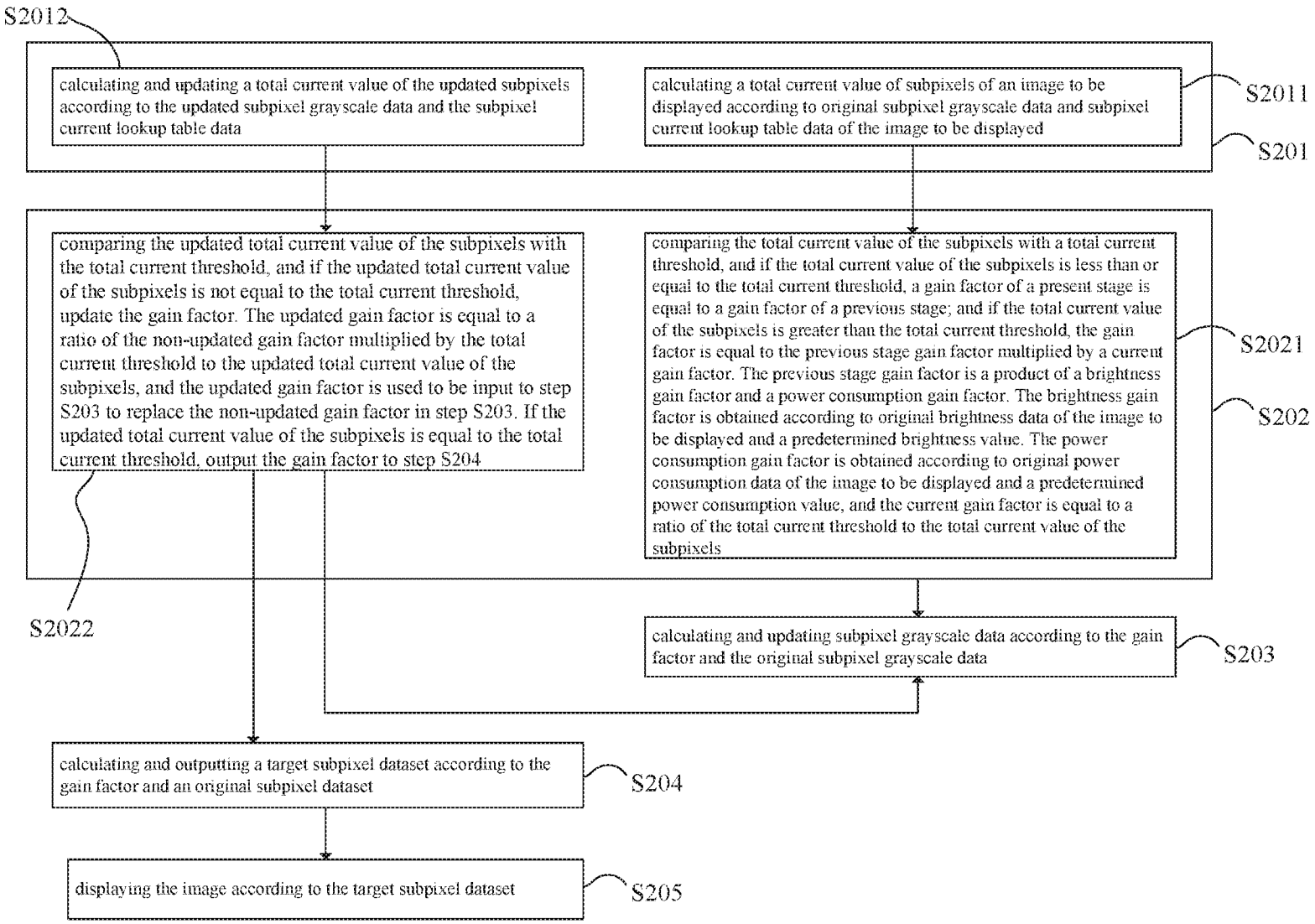
FIG. 2 is a flowchart showing a method of displaying an image of another embodiment of the present application.

Please refer to FIG. 2 showing a flowchart showing a method of displaying an image of another embodiment of the present application. The method of displaying the image includes following steps:

S2011: calculating a total current value of subpixels of an image to be displayed according to original subpixel grayscale data and subpixel current lookup table data of the image to be displayed.

Step S2011 is the same as step S101, and will not be described in detail herein.

S2021: comparing the total current value of the subpixels with a total current threshold, and if the total current value of the subpixels is less than or equal to the total current threshold, a gain factor of a present stage is equal to a gain factor of a previous stage; and if the total current value of the subpixels is greater than the total current threshold, the gain factor is equal to the previous stage gain factor multiplied by a current gain factor. The previous stage gain factor is a product of a brightness gain factor and a power consumption gain factor. The brightness gain factor is obtained according to original brightness data of the image to be displayed and a predetermined brightness value. The power consumption gain factor is obtained according to original power consumption data of the image to be displayed and a predetermined power consumption value, and the current gain factor is equal to a ratio of the total current threshold to the total current value of the subpixels.

Step S2021 is the same as step S102, and will not be described in detail herein.

S203: calculating and updating subpixel grayscale data according to the gain factor and the original subpixel grayscale data.

Specifically, updated subpixel grayscale data is obtained by multiplying the gain factor by the original subpixel grayscale data.

S2012: calculating and updating a total current value of the updated subpixels according to the updated subpixel grayscale data and the subpixel current lookup table data.

Specifically, an updated subpixel grayscale histogram is established according to the original subpixel grayscale data. Sum current of each of the subpixels according to the updated subpixel grayscale histogram and the subpixel current lookup table data to obtain the updated total current value of the subpixels of the image to be displayed. Step S2011 and step S2012 constitute step S201.

S2022: comparing the updated total current value of the subpixels with the total current threshold, and if the updated total current value of the subpixels is not equal to the total current threshold, update the gain factor. The updated gain factor is equal to a ratio of the non-updated gain factor multiplied by the total current threshold to the updated total current value of the subpixels, and the updated gain factor is used to be input to step S203 to replace the non-updated gain factor in step S203. If the updated total current value of the subpixels is equal to the total current threshold, output the gain factor to step S204. Step S2022 and step S2021 constitute step S202.

If the updated total current value of the subpixels is less than or equal to the total current threshold, update the gain factor. The updated gain factor is equal to a ratio of the non-updated gain factor multiplied by the total current threshold to the updated total current value of the subpixels, and the updated gain factor is to be input to step S203 to replace the non-updated gain factor in step S203. If the updated total current value of the subpixels is equal to the total current threshold, a total current value of an image corresponding to subpixel grayscale data adjusted according to the gain coefficient is equal to the total current threshold, thereby to control the current of an image displayed to the total current threshold. In this manner, power consumption can be limited at the same time when a screen of high brightness is achieved. That is, the gain coefficient is updated by an iterative calculation so that the updated total current value of the subpixels is equal to the total current threshold, thereby to control the current of an image displayed to the total current threshold, and power consumption can be limited at the same time when a screen of high brightness is achieved.

S204: calculating and outputting a target subpixel dataset according to the gain factor and an original subpixel dataset. Step S204 is the same as step S103, and will not be described in detail herein.

S205: displaying the image according to the target subpixel dataset. Step S205 is the same as step S104, and will not be described in detail herein.

Compared to the method of displaying the image as shown in FIG. 1, the method of displaying the image of this embodiment feeds back the gain coefficient to the calculation of the total current value of the image, and multiple times of iterative calculation can accurately limit the total current value of the image to the total current threshold.

Figure 3:
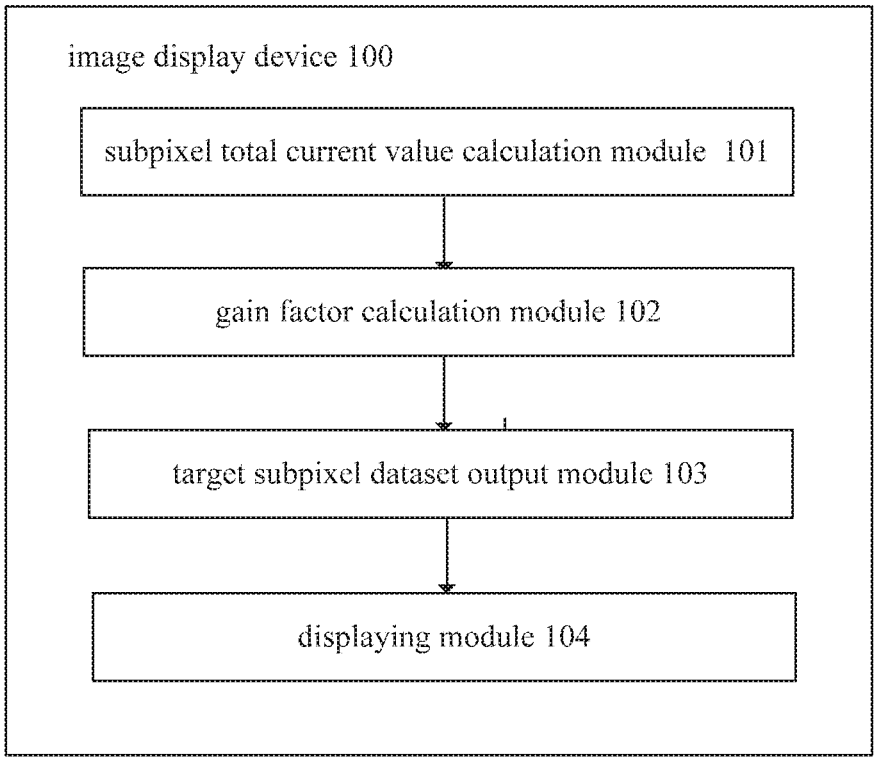
FIG. 3 is a schematic structural view of an image display device of an embodiment of the present application.

Please refer to FIG. 3 showing a schematic structural view of an image display device of an embodiment of the present application. The image display device 100 is an organic light-emitting diode display, a smart mobile device, or a tablet computer, etc.

The display device 100 includes: a subpixel total current value calculation module 101 configured to calculate a total current value of pixels of an image to be displayed according to original subpixel grayscale data and subpixel current lookup table data of the image to be displayed.

A gain factor calculation module 102 is configured to compare the total current value of the subpixels with a total current threshold, and if the total current value of the subpixels is less than or equal to the total current threshold, a gain factor of a present stage is equal to a gain factor of a previous stage. If the total current value of the subpixels is greater than the total current threshold, the gain factor is equal to the previous stage gain factor multiplied by a current gain factor. The previous stage gain factor is a product of a brightness gain factor and a power consumption gain factor. The brightness gain factor is obtained according to original brightness data of the image to be displayed and a predetermined brightness value. The power consumption gain factor is obtained according to original power consumption data of the image to be displayed and a predetermined power consumption value, and the current gain factor is equal to a ratio of the total current threshold to the total current value of the subpixels.

A target subpixel dataset output module 103 is configured to calculate and output a target subpixel dataset according to the gain factor and an original subpixel dataset.

A displaying module 104 is configured to display the image according to the target subpixel dataset.

In this embodiment, the subpixel total current value calculation module includes a grayscale histogram establishing module configured to establish a subpixel grayscale histogram according to the original subpixel grayscale data; and a total current value calculation module configured to sum current of each of the subpixels according to the subpixel grayscale histogram and the subpixel current lookup table data to obtain the total current value of the subpixels of the image to be displayed.

In this embodiment, the target subpixel dataset output module is configured to obtain the target subpixel dataset by multiplying the gain factor by data in the original subpixel dataset.

In this embodiment, the image display device further includes an input module configured to input the original subpixel dataset.

A method of displaying an image of the embodiment of the present application is implemented by calculating a total current value of subpixels of an image to be displayed, and comparing the total current value of the subpixels with a total current threshold, thereby to output a gain factor for adjusting brightness of an image to be displayed, so that an original subpixel dataset can be adjusted according to the gain factor, thereby enabling power consumption to be correspondingly limited at the time when an image is displayed to meet a high brightness requirement.

Figure 4:
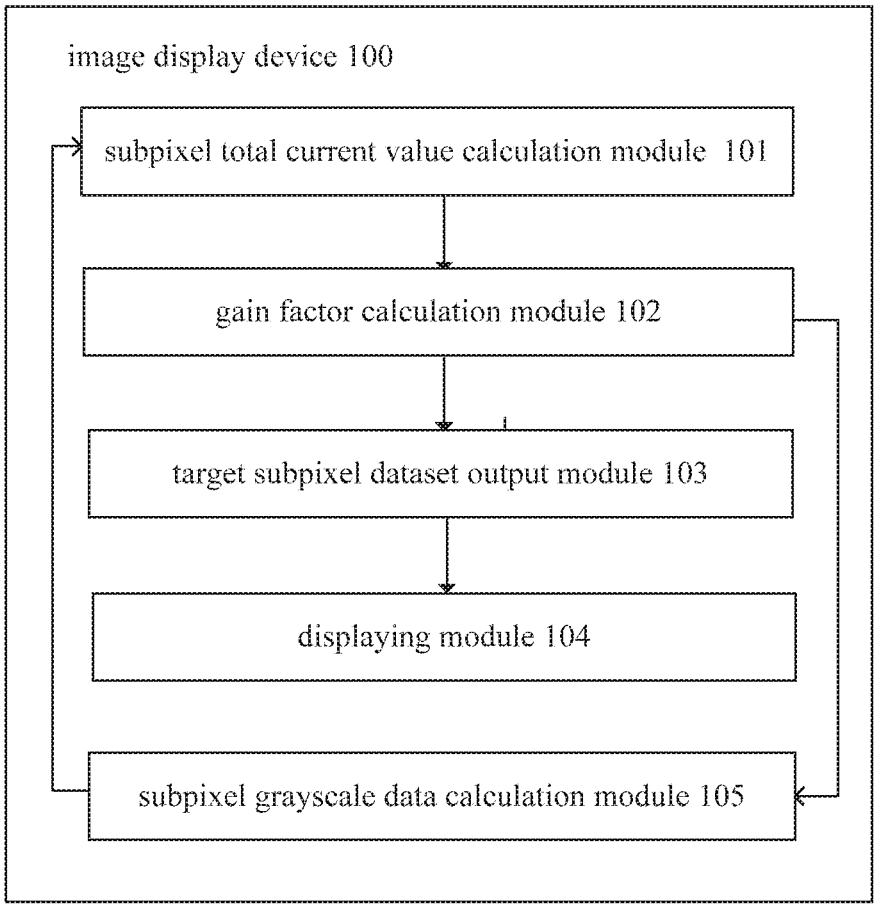
FIG. 4 is a schematic structural view of an image display device of another embodiment of the present application.

Please refer to FIG. 4 showing a schematic structural view of an image display device of another embodiment of the present application. The image display device 100 shown in FIG. 4 is basically similar to the image display device 100 shown in FIG. 3 except that the image display device 100 shown in FIG. 4 further includes a subpixel grayscale data calculation module 105 configured to calculate and update subpixel grayscale data according to the gain factor and the original subpixel grayscale data.

The subpixel total current value calculation module 101 is further configured to calculate and update the total current value of the subpixels according to the updated subpixel grayscale data and the subpixel current lookup table data.

The gain factor calculation module 102 is further configured to compare the updated total current value of the subpixels with the total current threshold, and if the updated total current value of the subpixels is not equal to the total current threshold, update the gain factor. The updated gain factor is equal to a ratio of the non-updated gain factor multiplied by the total current threshold to the updated total current value of the subpixels. The updated gain factor is used to be input to the subpixel grayscale data calculation module 105 to replace the non-updated gain factor, and if the updated total current value of the subpixels is equal to the total current threshold, the gain factor is output to the target subpixel dataset output module 103.

The description of the above embodiments is only for helping to understand the technical solution of the present application and its core ideas. It should be understood by those skilled in the art that the technical solutions described in the foregoing embodiments may be modified, or some of the technical features may be equivalently replaced; and the modifications or replacements do not make the essence of the corresponding technical solutions deviate from a range of technical solutions of the various embodiments of the present application.

What is claimed is:

1. A method of displaying an image, the method comprising the following steps:

step a: calculating a total current value of subpixels of an image to be displayed by summing current of each of the subpixels according to original subpixel grayscale data and subpixel current lookup table data of the image to be displayed;

step b: comparing the total current value of the subpixels with a total current threshold, and if the total current value of the subpixels is less than or equal to the total current threshold, a gain factor of a present stage is equal to a gain factor of a previous stage; and if the total current value of the subpixels is greater than the total current threshold, the gain factor is equal to the previous stage gain factor multiplied by a current gain factor;

wherein the previous stage gain factor is a product of a brightness gain factor and a power consumption gain factor, the brightness gain factor is obtained according to original brightness data of the image to be displayed and a predetermined brightness value, the power consumption gain factor is obtained according to original power consumption data of the image to be displayed and a predetermined power consumption value, and the current gain factor is equal to a ratio of the total current threshold to the total current value of the subpixels;

step c: calculating and outputting a target subpixel dataset according to the gain factor and an original subpixel dataset such that the target subpixel dataset is obtained by multiplying the gain factor by data in the original subpixel dataset, wherein the original subpixel dataset is called from a frame buffer and the data in the original subpixel dataset includes the original subpixel grayscale data; and step d: displaying the image according to the target subpixel dataset.

2. The method of displaying the image of claim 1, wherein step a comprises:

establishing a subpixel grayscale histogram according to the original subpixel grayscale data; and summing the current of each of the subpixels according to the subpixel grayscale histogram and the subpixel current lookup table data to obtain the total current value of the subpixels of the image to be displayed.

3. The method of displaying the image of claim 1, further comprising the following steps:

step e: calculating and updating subpixel grayscale data according to the gain factor and the original subpixel grayscale data;

wherein step a further comprises calculating and updating the total current value of the subpixels according to the updated subpixel grayscale data and the subpixel current lookup table data;

wherein step b further comprises:

comparing the updated total current value of the subpixels with the total current threshold, and if the updated total current value of the subpixels is not equal to the total current threshold, update the gain factor;

wherein the updated gain factor is equal to a ratio of the non-updated gain factor multiplied by the total current threshold to the updated total current value of the subpixels, and the updated gain factor is used to be input to step e to replace the non-updated gain factor in step e; and if the updated total current value of the subpixels is equal to the total current threshold, output the gain factor to step c.

4. The method of displaying the image of claim 1, wherein prior to step a, the method further comprises inputting the original subpixel dataset.

* * * * *